US008474145B2

(12) United States Patent
Tofaute et al.

(10) Patent No.: US 8,474,145 B2
(45) Date of Patent: Jul. 2, 2013

(54) LOCKING ELEMENT ADJUSTMENT SYSTEM FOR CYCLE SHOES

(75) Inventors: Kim Tofaute, Koblenz (DE); Peter Ejvinsson, Stockholm (SE); Frederik Ericsson, Johanneshov (SE)

(73) Assignee: RTI Sports Vertrieb Von Sportartikeln GmbH, Urmitz (DE)

( * ) Notice: Subject to any disclaimer, the term of this patent is extended or adjusted under 35 U.S.C. 154(b) by 701 days.

(21) Appl. No.: 12/675,574

(22) PCT Filed: Aug. 22, 2008

(86) PCT No.: PCT/EP2008/061021

§ 371 (c)(1),
(2), (4) Date: Feb. 26, 2010

(87) PCT Pub. No.: WO2009/027338

PCT Pub. Date: Mar. 5, 2009

(65) Prior Publication Data

US 2010/0307030 A1 Dec. 9, 2010

(30) Foreign Application Priority Data

Aug. 28, 2007 (DE) ..... 20 2007 012 024 U

(51) Int. Cl.
*A43D 1/02* (2006.01)

(52) U.S. Cl.
USPC ..... 33/3 R; 33/645

(58) Field of Classification Search
USPC ..... 33/3 A, 3 B, 3 C, 3 R, 613, 645
See application file for complete search history.

(56) References Cited

U.S. PATENT DOCUMENTS

| | | | | |
|---|---|---|---|---|
| 1,436,111 | A * | 11/1922 | Reich | 33/533 |
| 4,771,548 | A * | 9/1988 | Donnery | 33/512 |
| 7,281,333 | B2 * | 10/2007 | Caulliez et al. | 33/3 A |
| 7,536,794 | B2 * | 5/2009 | Hay et al. | 33/3 B |
| 7,571,544 | B2 * | 8/2009 | Champoux et al. | 33/1 N |
| 2006/0248965 | A1 * | 11/2006 | Wyatt et al. | 73/862.391 |
| 2007/0245835 | A1 * | 10/2007 | Hauschildt | 73/862.391 |
| 2010/0286951 | A1 * | 11/2010 | Danenberg et al. | 33/3 R |

FOREIGN PATENT DOCUMENTS

| | | |
|---|---|---|
| FR | 2 608 025 | 6/1988 |
| WO | WO 2005/025974 | 2/2005 |

OTHER PUBLICATIONS

International Search Report for PCT/EP2008/061021 dated Dec. 11, 2008.

* cited by examiner

*Primary Examiner* — G. Bradley Bennett
(74) *Attorney, Agent, or Firm* — Ohlandt, Greeley, Ruggiero & Perle, LLP

(57) ABSTRACT

A locking element adjustment system for cycle shoes has a base element and a receiving element. The receiving element serves for the positionally exact arrangement of the locking element in relation to the base element. Adjusting elements are provided on the base element.

15 Claims, 4 Drawing Sheets

LOCKING ELEMENT ADJUSTMENT SYSTEM FOR CYCLE SHOES

BACKGROUND

1. Field of the Disclosure

The disclosure relates to a locking element adjustment system for cycle shoes.

2. Discussion of the Background Art

Cycle shoes, which are used particularly in connection with pedals of mountain bikes, racing bikes and triathlon bikes, are provided with a fastening system for fastening the shoe to the pedal, particularly by click-on attachment. A known click-on system for use especially in mountain bike shoes comes from Shimano Inc. and is marketed under the tradename SPD.

The locking elements for connection to the sole of the cycle shoe, which are often referred to as cleats, have to be adjusted as precisely as possible. Connection of the locking elements is usually performed with the aid of two screws. The screws will be inserted through longitudinal holes provided in the sole of the shoe and will engage a threaded plate provided on the inner side of the shoe. Because of the provision of longitudinal holes in the sole of the shoe that are oriented in the longitudinal direction of the shoe, the locking elements can be adjusted in the longitudinal direction. Also the locking element itself comprises openings, again formed as longitudinal holes, in the region where the screws are passed through and the screw heads are received. The orientation of these longitudinal holes extends transversely to the longitudinal direction of the shoe. This makes it possible to displace or adjust the locking element laterally in relation to the shoe.

In practice, obtaining a precise adjustment of the locking elements on the cycle shoe is difficult and is based substantially on "trial and error". Measuring or defining the precise position will not be possible. Consequently, in many cases, frequent readjustment steps will be required until finding a position of the locking element that is agreeable to the user. Misadjustment of the locking element may result in knee problems and may even cause lasting damage in the knee joint.

The positions of the locking elements on both shoes should be identical to the largest possible extent. According to the present practice to achieve this condition, the user will observe the shoes from below and will adjust the position of the locking elements by eye. Frequently, this approach will lead to misadjustment because the sole of the shoe often happens to be laterally offset relative to the upper. As a result, even a perfectly identical positioning of the locking elements on the soles of the shoes cannot guarantee that the locking element will be arranged in the same position relative to the user's foot.

When arranging the cleats, it is also to be considered that the shoe should not touch the pedal crank during the pedal-pushing movement. Particularly during readjustment of an angled position, e.g. when the heel is turned inward, the heel or the ankle may touch the pedal crank. This will entail the necessity to alter the lateral position of the locking element. The resultant process is not only bothersome but will often cause an unintended change of position, particularly also in the longitudinal direction.

It is an object of the disclosure to provide a locking element adjustment system for cycle shoes which makes it possible to adjust the locking elements for cycle shoes in a simple manner.

SUMMARY OF THE DISCLOSURE

The locking element adjustment system for cycle shoes provided by the disclosure comprises a base element and a receiving element which preferably is connected to the base element. Said receiving element serves for receiving the locking element or cleat which has to be connected to the cycle shoe with positional accuracy. Herein, the receiving element is configured in such a manner that, with the aid of the receiving element, there can first be obtained a defined, positionally accurate reception of the locking element relative to the base element. This can be realized e.g. in that the base element is provided with a marking whereat the receiving element will be fastened to the base element e.g. by bonding. According to the disclosure, the base element is provided with adjusting elements. Such markings can be e.g. markings indicating the lateral distance of the locking element to the pedal crank, the angular position of the heel of the shoe, the orientation of the cleat in the longitudinal direction and relative to the pedal axis, respectively, and so forth.

The receiving element can be attached to the base element e.g. by bonding, by use of fixing elements or by similar means. Particularly, the base element can also be formed integrally with the receiving element, e.g. by molding from plastic.

According to a further embodiment of the disclosure, said receiving element for reception of the cleat is a component independent from the base element. This has the advantage that the shoe to which the cleat has to be mounted can first be adjusted relative to the base element or relative to adjusting elements provided on the base element, and can be fixed in the resultant position e.g. by use of holding elements. Subsequently, the exact position of the receiving element relative to the shoe can be attained by shifting and/or twisting the receiving element. For this purpose, the receiving element can have a holding element such as e.g. a rod connected to it. Preferably, said holding element extends laterally beyond the base element so that the receiving element can be moved by the holding element while the base element, e.g. with the shoe resting thereon, is being observed from above. The base element can be provided with a guiding element for holding and guiding the holding element therein. Said guiding element particularly serves the purpose of always keeping the holding element in abutment on an underside of the base element because, in case of a plane base element, the cleats need to be displaced only in one plane. Vertically to this plane or vertically to the shoe's sole, displacing the cleat is not required.

Thus, using the locking element adjustment system of the disclosure, the locking element can first be brought into a defined position relative to the base element. With the aid of the adjustment elements provided on the base element, which can be markings such as lines, indications of angles and the like, it will then be possible to adjust the exact position of the locking element relative to the cycle shoe. Particularly, the position of a locking element connected to the cycle shoe can be read from the adjustment elements. Thus, with the aid of the adjustment system, the position of a locking element can be transferred in simple manner from one shoe to another shoe. This has the advantage that the locking element will really take the same position on both shoes. Further, for instance, when locking elements have to be exchanged, it is possible to first determine the position of the to-be-exchanged locking element and to then fasten the new locking element again at exactly the same site on the shoe.

To achieve an optimally accurate and simple arrangement of the locking element relative to the base element, and thus relative to the adjusting elements or adjusting markings provided on the base element, it is preferred that the locking element will be received by the receiving element in a form-locking manner. Preferably, the receiving element comprises projections which allow for such a form-locking reception.

The e.g. pin-shaped projections are preferably arranged to the effect that the locking element will be received between the projections, there being provided preferably three projections which are to be abutted by the locking element. Thus, the projections are with preference arranged on an outer contour of the locking element.

With particular preference, the shape or contour of the projections at least partially corresponds to a part of the outer contour of the locking element. Consequently, the individual projections are formed corresponding to a wall whose shape at least partially corresponds to a part of the outer contour line.

According to a particularly preferred embodiment, there is provided a sole projection or wall element which surrounds the locking element. The shape or contour of this wall element at least partially corresponds to the outer contour line of the locking element.

Preferably, the individual projections or the wall element are configured to allow locking elements from different manufacturers to be received by the receiving element with positional accuracy, preferably in a form-locking manner, thus attaining a precise position relative to the base element.

Preferably, the receiving element comprises a through opening so as to make it possible, for instance, to tighten the fastening screws of the locking elements when the locking element adjustment system has been placed on the sole of the shoe. Either the complete receiving element is formed as a through opening, or there is provided at least one through opening by which the screws are exposed.

Preferably, the base element is provided as a plane plate which is at least partially transparent. With particular preference, the base element is formed in one piece with the receiving element, the preferred material being plastic. The adjusting elements are with preference formed as markings, preferably lines, which are applied by printing, embossing etc. Said lines can be provided with indications of e.g. specific types of pedals, or with numbers or letters. Preferably, the adjusting elements comprise a pedal line formed by the pedal axis. Further, a longitudinal symmetry line can be provided as an additional adjusting element. The longitudinal symmetry line is an extension of the symmetry line of the locking element. Preferably, the longitudinal symmetry line projects beyond the heel element of the cycle shoe so that, when the user is looking from above onto the cycle shoe placed on a locking element adjustment system, the longitudinal symmetry line will be visible.

Apart from the longitudinal symmetry line, further lines can be provided, particularly in a fan-shaped configuration. Preferably, all lines intersect with the longitudinal symmetry line in the center of the locking element, preferably on the point of intersection between the longitudinal symmetry line and the pedal line. Further, the adjusting elements can comprise crank lines. These are to be understood as lines arranged parallel to the longitudinal symmetry line while spaced apart from the receiving element, and which serve for visualizing the distance between the receiving element and the pedal crank. Particularly the crank lines can be provided with indications of pedal types because the distance between the locking-element receiving element of the pedal and the pedal crank, and thus between the locking element and the pedal crank, is defined substantially by the pedal type.

Further, the adjusting elements can be provided in the form of transfer lines or transfer markings on the base element. Said transfer lines or markings serve for transfer of the position of a locking element onto the respective other shoe or, if locking elements have to be exchanged, for applying the new locking element on the shoe in exactly the same position as the old locking element.

The receiving element for receiving the locking element preferably has the outer contour of customary locking element or cleats. Preferably, these will be cleats from the Shimano company, bearing the tradename "SPD", and cleats from the Look company.

The base element preferably is of an areal shape and has a suitable size to ensure that the whole shoe will be resting on the base element. It is preferred in this regard that the base element, when viewed in cross section, comprises a raised portion in the region of the heel so that the front part of the cycle shoe where the cleat is fastened will be oriented substantially parallel to the base element. Hereby, it is safeguarded that the locking element or cleat is safely held in a projection or frame element of the receiving element. According to a particularly preferred embodiment, the base element, preferably made of plastic, is of a hollow shape at least in the region of said raised portion at the heel. In this manner, a bin can be established for accommodation of an instruction manual or the like.

Preferably, a respective separate base element is provided for the left shoe and the right shoe. These base elements can be fastened to each other or be formed in one piece with each other. In this regard, it is preferred that the two base elements are attached to each other in a manner allowing them to be folded so that the required storage space will be small. Said attachment can also be realized by a living hinge or the like.

The disclosure will be explained in greater detail hereunder with reference to the accompanying drawings.

DETAILED DESCRIPTION OF THE PREFERRED EMBODIMENT

Figure 1:
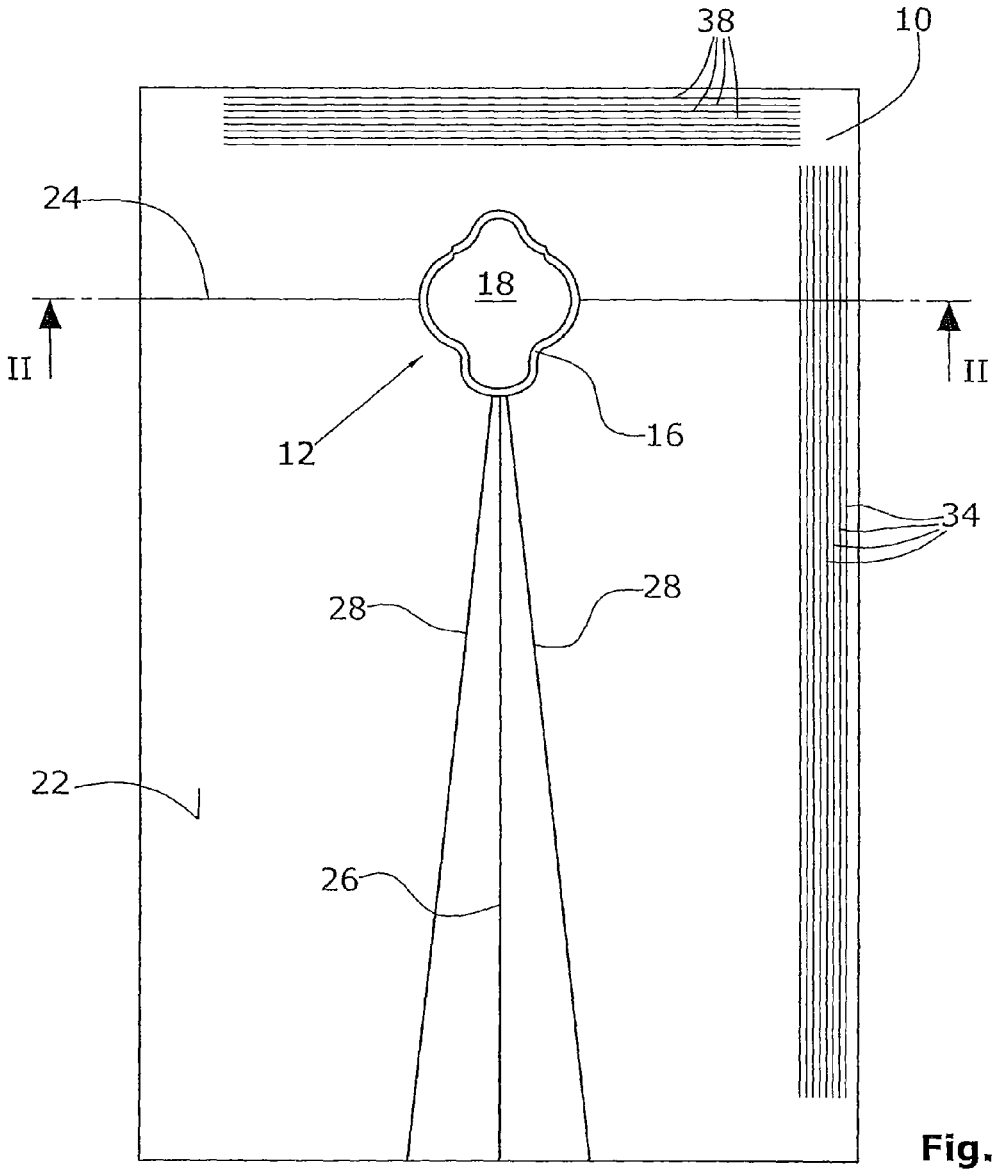
FIG. 1 is a schematic plan view of a preferred embodiment of the locking element adjustment system of the disclosure.
Figure 2:
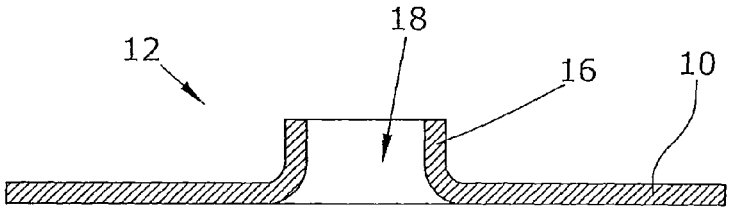
FIG. 2 is a schematic sectional view taken along the line II-II.

According to a preferred embodiment, a base element 10, preferably made of transparent plastic, is integrally connected to a receiving element 12. In the first preferred embodiment (FIGS. 1 to 4), for effecting a positionally exact placement of a locking element 14 (FIG. 3), the receiving element comprises a wall element 16 which fully surrounds the locking element 14. Wall element 16 has a contour corresponding to the outer contour of locking element 14 so that the locking element 14 will be received in form-locking engagement in an opening 18 (FIG. 1) of receiving element 12. Said opening 18 is formed as a through opening, with the size of the opening corresponding to the base surface of the locking element so that the locking element could be passed through opening 18. Optionally, parts of opening 18, particularly in regions where no fastening screws 20 (FIG. 3) are provided, are closed so as to allow the locking element to be inserted into base element 10 and to prevent the locking element 14 to fall out or slip through.

In the illustrated embodiment, adjusting elements are arranged on a top side 22 of base element 10. These adjusting elements are provided in the form of markings applied e.g. by printing.

One adjusting element consists of a pedal line 24. The pedal line is provided to mark the pedal axis. This, accordingly, is the central axis of the pedal around which the pedal will be rotated. Via this axis, the force will be transmitted onto the pedal crank during the pedal-pushing.

A further adjusting element consists in the longitudinal symmetry axis 26. This is the longitudinal symmetry axis of the locking element and respectively of the extension thereof which is shown on the top side 22 of base element 10. In the illustrated embodiment, two heel lines 28 are provided, arranged in a fan-shaped configuration respectively at an identical angle to said longitudinal symmetry line and serving for adjustment of the pivoting of heel element 30 (FIG. 4) of cycle shoe 32.

Further adjusting element consist of crank lines 34 arranged parallel to the longitudinal symmetry line 26. With the aid of the crank lines, a distance of the locking element and respectively the center of the locking element to the pedal crank can be defined. Optionally, the individual crank lines 34 are provided with numbers or letters. These numbers or letters can optionally refer to pedal types because the distance between the locking element and the pedal crank arm is substantially defined by the pedal type. Further, the individual pedal types of interest can be printed immediately onto the surface 22 of base element 10.

Figure 4:
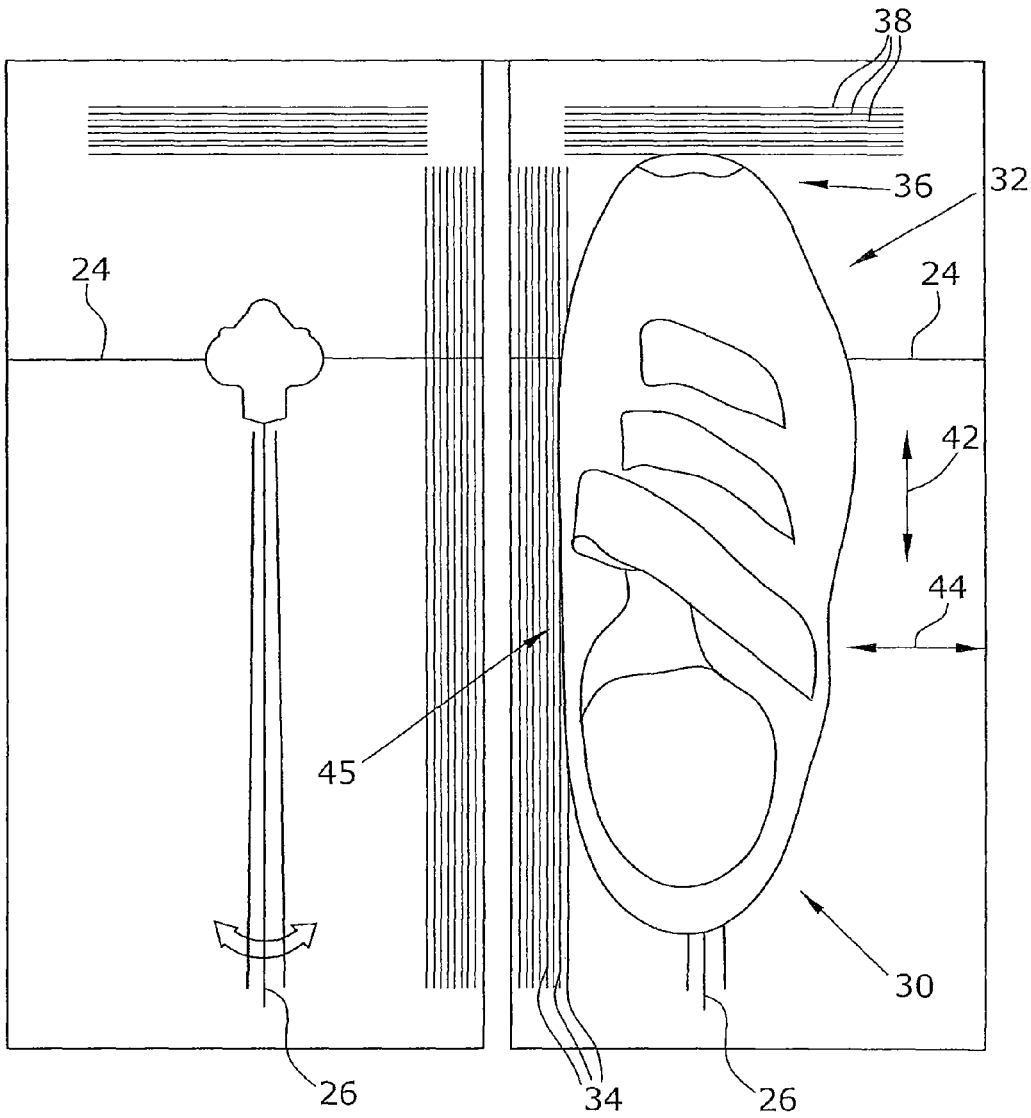
FIG. 4 is a schematic view plan view of a locking element adjustment system for both shoes, with one shoe being schematically outlined.

Additionally, transfer lines 38 (FIG. 1), extending parallel to pedal line 24, can be arranged in the region of the tip 36 of a shoe (FIG. 4). Said transfer lines 38 are preferably provided with numbers (FIG. 4).

For positionally accurate placement of locking element 14 on a shoe sole 40 of a cycle shoe 32, the following steps can be performed:

In a first step, the user will put on one of the two shoes and grope for the base joint of the big toe on the inside of the shoe. The position of the base joint of the big toe will then be marked on the shoe, e.g. with the aid of a crayon, a sticker or the like. Subsequently, the locking element will be loosely attached to the sole 40 of shoe 32 by placing, on the shoe and usually inside the shoe, a plate provided with threads to be engaged by screws 20 for fixation of the locking element. For the time being, the screws will not be tightened yet.

Figure 3:
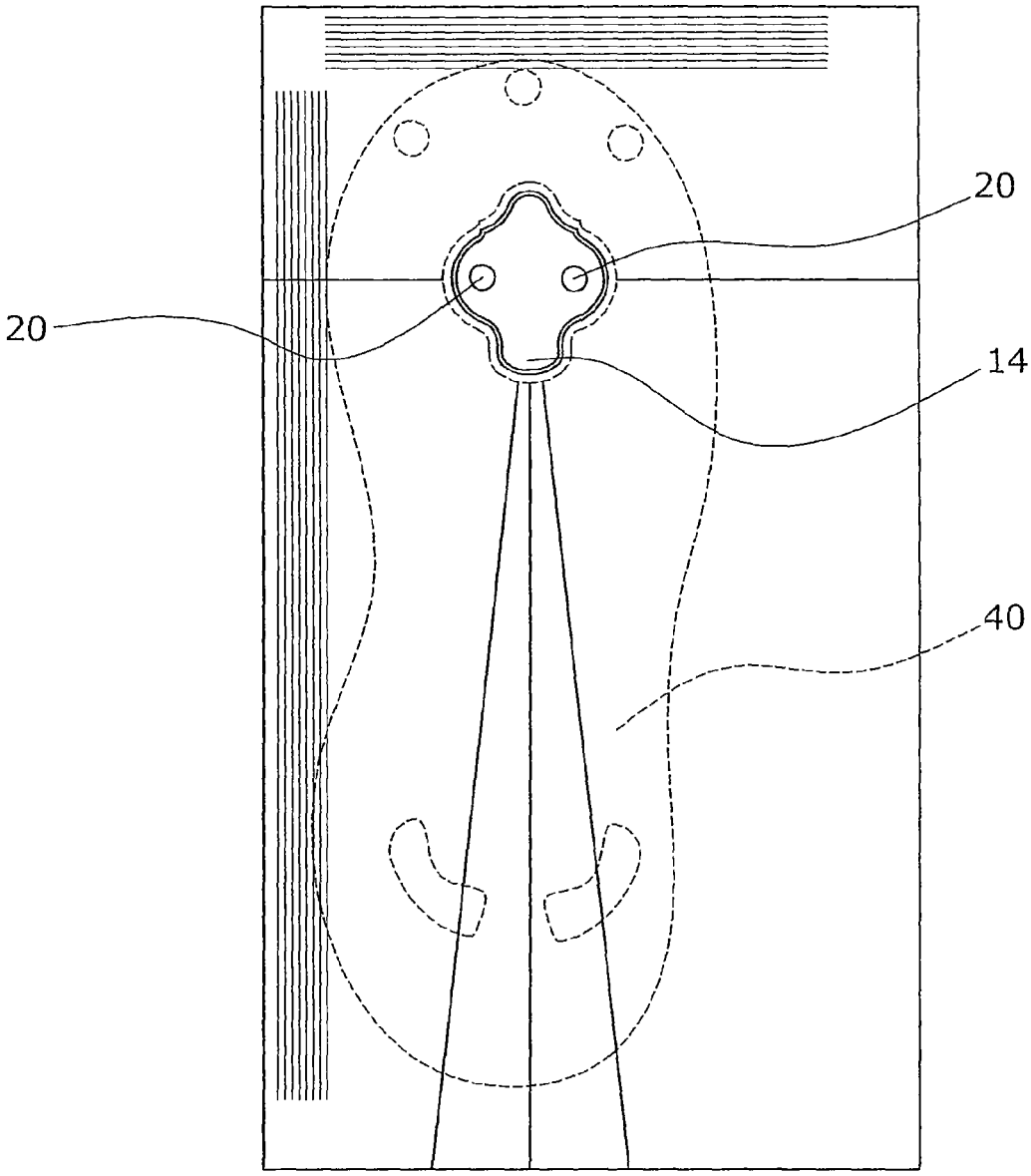
FIG. 3 is a schematic view from below onto a cycle shoe, with the locking element adjustment system placed onto the sole of the cycle shoe.

Now, the locking element will be inserted into opening 18, as evident particularly in the bottom view of FIG. 3. The shoe 32 will then be shifted in the direction indicated by arrow 42 (FIG. 4) until the marking of the base joint of the big toe is in alignment with pedal line 24. In this manner, there is safeguarded a good force transmission onto the pedal and, via the pedal axis, onto the pedal crank.

Thus, the adjusting of the locking element in the longitudinal direction relative to shoe 32 is already finished. The position can be read from the transfer lines.

Next, the lateral adjustment of the shoe will be performed so as to avoid contact with the pedal crank. Herein, for obtaining an optimal force transmission, it is desirable to arrange the shoe as closely as possible to the pedal crank. For this purpose, said crank lines 34 are provided. On the one hand, the crank lines can bear pedal-specific markings so that the adjusting of the shoe in the direction of arrow 44 (FIG. 44) can be carried out in a simple manner. Also, the corresponding crank line 34 can be detected by first placing the base element 10 onto the pedal such that the locking-element receiving element of the pedal will be arranged within opening 18, and by a positional search along the pedal crank. Now, the shoe will be displaced in the direction of arrow 44 (FIG. 4).

The heel angle, i.e. the degree of rotation of heel element 30 of shoe 32, will substantially depend on the anatomy of the user and has to be determined empirically. For a start, a central position appears useful, with the center of heel element 30 thus arranged above the longitudinal symmetry line 26.

The position of the locking element has now been defined so that the screws 30 can be tightened.

The positionally accurate fixing of the locking element of the second shoe is considerably easier. For this purpose, it is merely required to place the left-hand shoe onto the locking element adjustment system shown on the left in FIG. 4 wherein, again, the not yet tightened locking element will be arranged within opening 18. The left-hand shoe will thus be oriented corresponding to the right-hand shoe. In the process, the longitudinal orientation in the direction of arrow 42 can be accomplished in a simple manner by reading the corresponding position from the transfer lines 38 and correspondingly shifting the left-hand shoe in the direction of arrow 42. This will be possible also with respect to the transverse shifting in the direction of arrow 44 since, also to this end, the crank lines 34 can be used as transfer lines. Herein, the position of the heel will be attained automatically.

In case that worn-out locking elements on a shoe 32 shall be exchanged, it will be most convenient to place the shoe with the old locking elements onto the locking element adjustment system prior to demounting the locking elements, with the old locking element being positioned within said through opening 18. Thus, the position of the tip 36 of the shoe and of an inner side 45 of the shoe can be read from the transfer lines 38,34. Subsequently, the new locking element will be loosely mounted, the shoe will again be placed onto base element 10 and be oriented in correspondence with the noted transfer lines 38,34. Then, the screws 20 of the new locking element can be tightened.

In the context of a further embodiment (FIGS. 5 and 6) of the locking element adjustment system, identical or similar components are provided with the same reference numerals.

The only difference between the two adjusting systems shown in the Figures as preferred embodiments resides in that the second embodiment (FIGS. 5 and 6) comprises projections and respectively pins 46 instead of said wall element 16. Said pins 46 are arranged along an outer contour line 48 so that a locking element 14 can be arranged positionally accurately within the pins 46.

Figure 5:
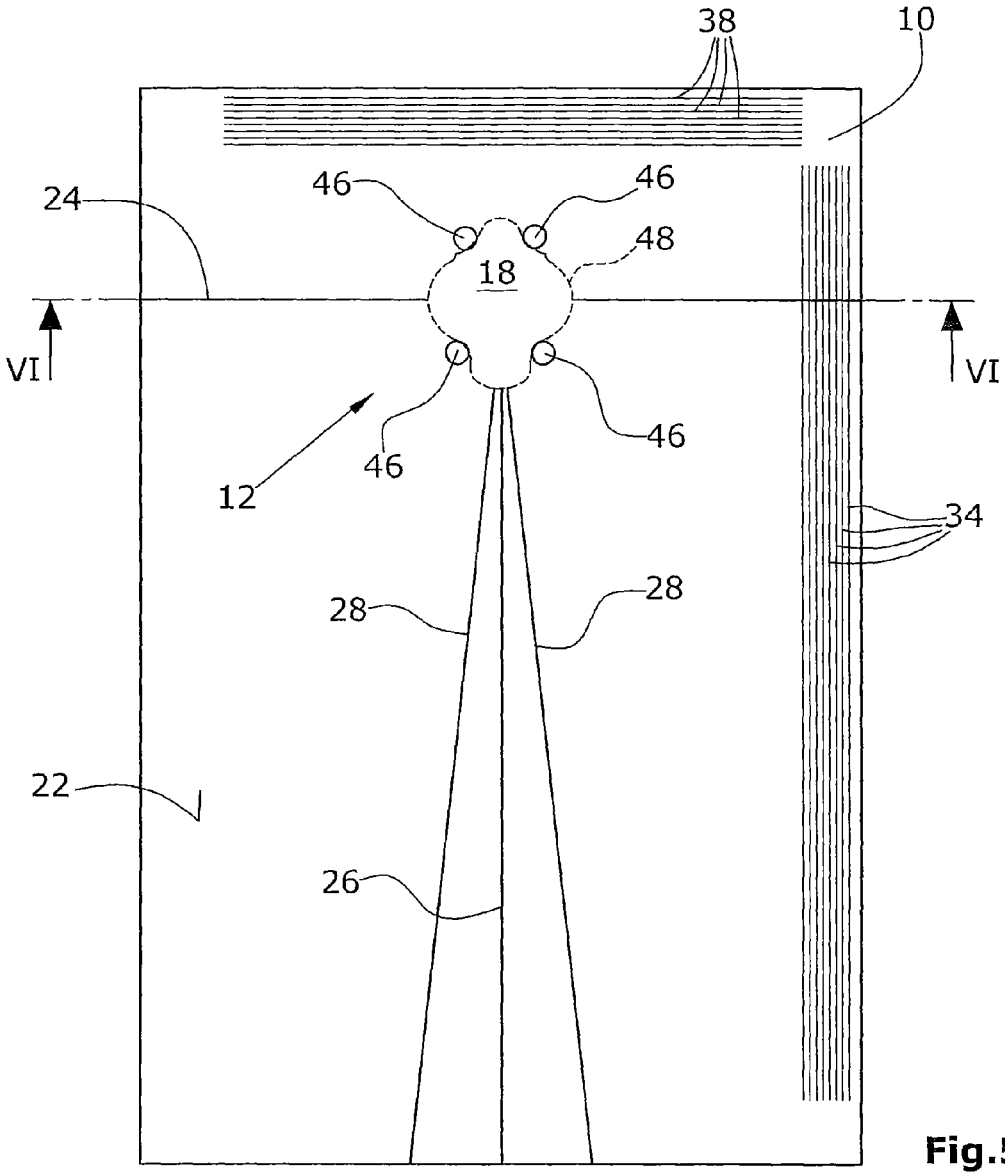
FIG. 5 is a schematic view plan view of a further embodiment of the locking element adjustment system.
Figure 6:
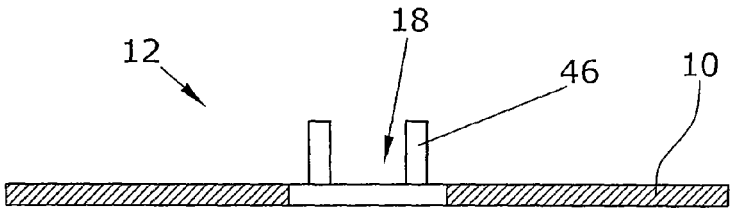
FIG. 6 is a schematic sectional view taken along the line VI-VI in FIG. 5.

Also when using the locking element adjustment system depicted in FIGS. 5 and 6, the adjustment of the locking elements on a cycle shoe is performed as described above in connection with the first preferred embodiment.

What is claimed is:

1. A locking element adjustment system for a cycle shoe, comprising:

a base element, a receiving element adapted to be oriented relative to the base element, for positionally precise arrangement of the locking element relative to the base element, and adjusting elements provided on the base element, wherein the base element and the receiving element are connected in one piece, and wherein the adjusting elements comprise a plurality of crank lines arranged at different distances to the receiving element, said crank lines indicating the distance between the receiving element and a pedal crank.

2. The locking element adjustment system according to claim 1, wherein the receiving element receives the locking element in a form-locking manner.

3. The locking element adjustment system according to claim 1, wherein the receiving element comprises projections by which the locking element is arranged with positional accuracy.

4. The locking element adjustment system according to claim 3, wherein the projections are arranged on an outer contour line of the locking element.

5. The locking element adjustment system according to claim 3 or 4, wherein the shape of the projections at least partially corresponds to a respective part of the outer contour of the locking element.

6. The locking element adjustment system according to claim 1, wherein the receiving element comprises a wall element at least partially surrounding the locking element, the shape of said wall element at least partially corresponding to the outer contour of the locking element.

7. The locking element adjustment system according to claim 1, wherein the receiving element comprises a through opening extending at least over a part of the base surface of the locking element.

8. The locking element adjustment system according to claim 1, wherein the base element comprises a plane plate which is at least partially transparent.

9. The locking element adjustment system according to claim 1, wherein the base element and the receiving element are made of plastic.

10. The locking element adjustment system according to claim 1, wherein the adjusting elements comprise a pedal line extending through the locking element and visually representing the pedal axis.

11. The locking element adjustment system according to claim 10, wherein the adjusting elements comprise a longitudinal symmetry line being an extension of the longitudinal symmetry line of the locking element.

12. The locking element adjustment system according to claim 11, wherein, when the cycle shoe has been placed on the base element for mounting the locking element, said longitudinal symmetry line projects beyond the heel element of the cycle shoe.

13. The locking element adjustment system according to claim 1, wherein the adjusting elements comprise a plurality of transfer lines for transfer of adjustment settings from one cycle shoe to another cycle shoe.

14. A locking element adjustment system for a cycle shoe, comprising:

a base element, a shoe receiving element fixedly connected to the base element, and lateral adjusting elements provided on the base element, the adjusting elements comprising a plurality of crank lines arranged at different lateral distances to the shoe receiving element, said crank lines indicating the distance between the receiving element and a pedal crank.

15. A method for positionally accurate placement of a locking element on a shoe sole of a cycle shoe, comprising:

placing a foot of a user in the cycle shoe, marking a base joint of the user's big toe on the cycle shoe, loosely attaching the locking element to the shoe sole, inserting the locking element into an opening of a base element, shifting the cycle shoe in a first direction until the marking of the base joint of the big toe is in alignment with a pedal line on the base element, placing the base element onto the pedal such that a locking-element receiving element of the pedal is arranged within the opening of the base element and displacing the cycle shoe laterally to a pedal-specific marking on the base element, rotating a heel element of the shoe so that a center of the heel element is arranged above a longitudinal symmetry line on the base element, and securing the locking element in position on the cycle shoe.

* * * * *